US009388633B2

(12) United States Patent
Iglesias Ballester

(10) Patent No.: US 9,388,633 B2
(45) Date of Patent: Jul. 12, 2016

(54) QUICK-OPENING DOOR

(71) Applicant: Amiserru, S.L., Barcelona (ES)

(72) Inventor: Miguel Angel Iglesias Ballester, Barcelona (ES)

(73) Assignee: Amiserru, S.L., Barcelona (ES)

( * ) Notice: Subject to any disclaimer, the term of this patent is extended or adjusted under 35 U.S.C. 154(b) by 0 days.

(21) Appl. No.: 14/400,463

(22) PCT Filed: May 9, 2013

(86) PCT No.: PCT/ES2013/070296
§ 371 (c)(1),
(2) Date: Nov. 11, 2014

(87) PCT Pub. No.: WO2013/167786
PCT Pub. Date: Nov. 14, 2013

(65) Prior Publication Data

US 2015/0136334 A1 May 21, 2015

(30) Foreign Application Priority Data

May 11, 2012 (ES) ..... P201230719

(51) Int. Cl.

| | |
|---|---|
| ***E06B 9/68*** | (2006.01) |
| ***E05D 15/16*** | (2006.01) |
| ***E06B 9/13*** | (2006.01) |
| ***E05F 15/48*** | (2015.01) |

(Continued)

(52) U.S. Cl.
CPC ..... *E06B 9/68* (2013.01); *E05D 15/165* (2013.01); *E05F 15/48* (2015.01); *E05F 15/77* (2015.01); *E06B 9/13* (2013.01); *E06B 9/56* (2013.01); *E05Y 2400/338* (2013.01); *E05Y 2900/00* (2013.01); *E05Y 2900/106* (2013.01); *E06B 9/581* (2013.01); *E06B 2009/6818* (2013.01); *E06B 2009/6845* (2013.01)

(58) Field of Classification Search
CPC ..... E06B 9/581; E06B 9/70; E06B 9/80; E06B 9/82; E06B 9/90; E06B 2009/6836; E06B 9/68; E06B 9/56; E06B 9/13; E06B 2009/6818; E06B 2009/6845; E05F 15/77; E05F 15/48; E05F 15/165; E05Y 2900/106; E05Y 2900/00; E05Y 2400/338
USPC ..... 160/310, 272, 273.1, 3, 8
See application file for complete search history.

(56) References Cited

U.S. PATENT DOCUMENTS 5,058,651 A * 10/1991 Ashley ..... E06B 9/581 160/271
5,198,974 A * 3/1993 Orsat ..... E06B 9/70 160/133

(Continued)

*Primary Examiner* — Blair M Johnson
(74) *Attorney, Agent, or Firm* — Baker and Rannells, PA

(57) ABSTRACT

The invention refers to a quick-opening door comprising: a flexible canvas secured to a motor-driven drum and provided with vertically aligned arrangements of abutment elements that are guided in vertical uprights of the door; an electric duct secured to one of the sides of the canvas and provided with cables connected to a wireless signal transmitter; a plurality of guiding abutment elements distributed along the sides of the canvas with different spaces there between, disposed either singly or in groups; sensors which are disposed in an abutment passage zone and which capture different sequences of pulses during the passage of the abutment elements, thereby determining the position of the canvas at all times; and a contact-detecting band connected to the transmitter via the electric duct and housed in a bag by means of which the canvas is fitted against the ground.

11 Claims, 4 Drawing Sheets

(51) Int. Cl.

| | |
|---|---|
| ***E05F 15/77*** | (2015.01) |
| ***E06B 9/56*** | (2006.01) |
| *E06B 9/58* | (2006.01) |

(56) References Cited

U.S. PATENT DOCUMENTS 6,070,642 A * 6/2000 Douglas ..... E06B 9/54 160/290.1
6,119,759 A * 9/2000 Assaad ..... E06B 9/34 160/133
6,494,246 B1 * 12/2002 Blevins ..... E04F 10/0614 135/88.12
7,034,682 B2 * 4/2006 Beggs ..... E06B 9/581 160/1
7,472,739 B2 * 1/2009 Heidenreich ..... E04F 10/0648 160/122
8,069,897 B2 * 12/2011 Kraeutler ..... E06B 9/56 160/1
8,783,327 B2 * 7/2014 Kraeutler ..... E06B 9/13 160/1
2005/0211391 A1 * 9/2005 Varley ..... E06B 9/13 160/67
2014/0060757 A1 * 3/2014 Thompson ..... E06B 9/44 160/238

* cited by examiner

QUICK-OPENING DOOR

OBJECT OF THE INVENTION

The present invention refers to a quick-opening door, of the type comprising a flexible canvas, secured by its upper end to a motor-driven drum for its winding in an opening position and its unwinding in a closing position of the door; having said canvas in its lateral ends vertical alignments of abutment elements which are guided in vertical uprights of the door during the vertical displacement of the canvas, leaving said vertical uprights when the canvas receives a push action of a certain intensity.

FIELD OF THE INVENTION

The invention is applicable to the field of the manufacture of closing devices and particularly quick-opening passage doors.

BACKGROUND OF THE INVENTION

Nowadays, quick-opening doors made out of an element of canvas or other type of flexible laminar element, secured by its upper end to a motor-driven drum which according to the rotation sense, establishes the winding or unwinding of the canvas, putting the same in a opening position or a closing position of door, are widely known.

It is also known in this type of quick-opening doors that canvas has in its lateral ends vertical alignments of abutment elements which are guided within vertical uprights of the door during the vertical displacement, upwards or downwards, of the sheet element being dimensioned said abutment elements and vertical uprights to permit that the abutment elements may release the uprights when the canvas receives a frontal push of a certain intensity, thus preventing its severance.

It is also known in this type of quick-opening doors to incorporate in the the upper area of the vertical uprights, of guides which have the objective to automatically return the abutment elements towards the internal region of the uprights once the canvas has been disassembled due to a frontal blow. In this way, the self-repair of the door is obtained making it unnecessary to resort to the intervention of a technical service or specialized personal.

In some industrial installations, it is usual that these type of quick-opening doors suffer repetitive frontal blows, by the approximation of vehicles to an excessive speed, or by the fact that the height of the load transported by the trolleys or vehicles is such that the door does not have enough time to reach its maximum degree of opening, nor the necessary height to permit that the load may pass under the canvas.

Given the fact that the requirements and conditions for the operation of the quick-opening doors are not the same in different types of industry using them, it is difficult to determine what are the reasons originating that the canvas of the door receives repetitive blows which provoke the release of the abutment elements from the guides of the vertical uprights.

This lack of information prevents to determine the reason for repeated incidences that if produced in a high frequency may be the reason for the accelerated spoilage of the canvas or abutment elements making necessary its substitution or repair by the manufacturer or pertinent technical services; therefore it also hampers the modification of the operation regime to make it to work according to parameters capable of preventing or reducing the frequency of incidences.

Another drawback of this type of doors is the difficulty to obtain the correct adjustment between the abutment element of the canvas and the vertical uprights to obtain the release of the abutment elements, preventing the severance of the canvas, when the door suffers a blow; and to make this adjustment adequate in order that the abutment elements do not release the vertical uprights when the canvas is submitted to efforts of lesser intensity which would not break the canvas, such as the push provoke by the wind.

This drawback is determined by the fact that the canvas, when receiving a frontal blow, curves toward the opposed side forming its ends an angle in respect of the means provided in the vertical uprights for the guidance of the abutment elements, which modifies the effort necessary in order that the abutment elements free themselves from the uprights of the frame of the door.

The inventor does not known the eventual existence of prior art to give a solution to the above stated problems.

DESCRIPTION OF THE INVENTION

The quick-opening door which is the subject of this invention, which corresponds to the above mentioned type, has construction particularities aimed to determine the position of the canvas in a maintained form during ascent and descent displacements, which permits to change the operating conditions of the door, for instance, in what refers the speed of winding or unwinding of the sheet element and accordingly the time necessary for opening the door preventing in this way the repetitive incidences concerning the generation of blows on the sheet element and the release of the side abutment elements, obtaining an increase of the useful service life of the door.

One of the objectives of the invention, is the use of vertical uprights formed by a metallic profile and a guide member for the displacement of the abutment elements of the canvas, being said guide member assembled on the metallic profile with possibility of rotation and to orientate itself sideways as a function of the direction of the efforts transmitted by the canvas to the said guide member of the vertical uprights.

To this end the quick-opening door which is the subject of the present invention, which is of the type of the above mentioned doors and is described in the preamble of the first claim comprises:—a hose carrying electrical cables, covered by a tape or sheath welded to the same and secured to one or both side ends of the canvas, containing one o various electrical cables connected to a wireless signal transmitter;—a plurality of guiding abutment elements secured on the lateral ends of the sheath and distributed along said side ends with different separations, in an individual form or by means of groups and assembled with the capacity to displace vertically in respect of the vertical upright of the door;—some sensors arranged in a passage area of the abutment elements which capture different sequences of impulses, also called pulse trains, during the passage of the abutment elements distributed with different separations in the side ends of the canvas, determining the position of the canvas in any given moment; and—a contact detecting band connected to the transmitter by means of the cables contained in the hose and located within a bag for the adjustment of the canvas on the floor.

The abutment elements secured on the side ends of the tape or sheath protect said tape or sheath from eventual blows or deterioration by use and, in its turn, permitting that the tape or sheath carries out the self-centering of the abutment elements.

The bag to be adjusted to the floor is secured to the lower end of the canvas and has inside a sheath containing a weight to guarantee that the adjustment bag contacts the floor, establishing a closing action on the same when the door reaches the closing position.

The door has in the area of passage of the guiding abutments, one or more sensors for detecting the passages of the abutment elements, determining the position of the canvas at all times.

According to the invention, the abutment elements are interchangeable and self-centering in respect to the hose carrying the electrical cables, having arranged that said abutment elements are distributed lengthwise of the canvas with different separations, in an individual form or by means of groups, with the aim that the sensors may capture different pulse sequences in different positions of the canvas, providing a reliable information on the real situation of the canvas.

Given that the canvas requires a reduced number of abutment elements for its effective guiding, the location and separation of the rest of the abutment elements will be carried out depending on the information which is to be captured by means of the sensors: for instance, braking ramp, displacement for the recovery, etc.

When the canvas hits vertically against an obstacle during its descent movement, its end cannot continue its descent, which provokes the abutment elements to superimpose to each other, accumulating vertically. By the use of the above mentioned abutment elements and the sensors which may consist, for instance, in optical sensors to detect the abutment elements without collision or noise, in the case that an accumulation of the abutment elements occurs, this accumulation will be detected by the sensors provoking the recovery movement of the canvas by the activation of the winding drum in the sense of recovery.

According to the invention, each one of the vertical uprights of the door comprises: a vertical profile with a channel having a front opening or mouth and a guide member also vertical which has an internal passage for the vertical displacement of the abutment elements, a frontal opening for the passage are vertical circulation of the side ends of the canvas carrying the abutment elements and a rear arm ending in a vertical appendage having at least one portion located within the lengthwise channel of the profile.

The internal passage and the front opening of the guide member determine that this latter has in the front area a "U" form section elastically deformable in the sufficient measure to permit the exit of the abutment elements when the canvas receives a fontal or oblique push of a determined intensity.

The abutment elements secured on the said ends of the tape or sheath form a protection means for said tape or sheath against eventual blows and against deterioration by use. In its turn, the tape or sheath forms self-centering means for the abutment elements.

The back arm of the guide member has a thickness which is inferior to that of the front mouth or the vertical profile making possible the sideways rotation of the guide member in respect to the vertical profile when the canvas is deformed toward the interior or towards the exterior of the closing structure, by the action of the wind, or the action of a trolley or any other external force.

In the invention is has been foreseen that the side ends of the canvas have independent electric cable carrying hoses.

In a form of the embodiment, the guide member has in its upper part some supports in which an optical sensor is located to detect the vertical displacement of the canvas.

Said supports comprise antifriction elements channeling the canvas towards the interior of the guide member in case that said canvas has been released from said guide member, for instance, due to a blow.

The invention provides the possibility that the electrical cables contained in the flexible hoses may be connected to a mechanical transmitter capable to transmit signals in a form other than wireless.

DESCRIPTION OF THE DRAWINGS

To complement the description of the invention and with the object to facilitate the understanding of the characteristics of the same, some drawings are annexed to this description in which in an illustrative, but not limitative form, the following has been shown.

PREFERRED EMBODIMENT OF THE INVENTION

Figure 1:
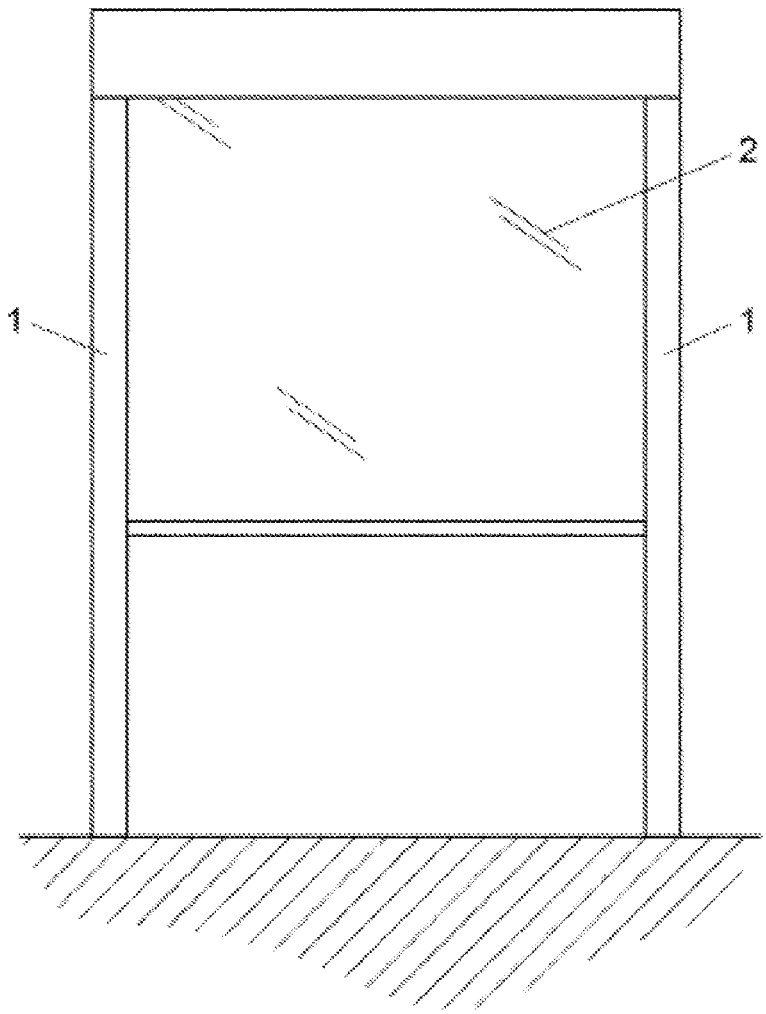
FIG. 1 shows a front elevation view of an example of embodiment of the quick-opening door according to the invention with the canvas in an intermediate opening position.

As may be observed in FIG. 1 the quick-opening door of this invention corresponds to the type which comprises two vertical uprights (1) for vertically guiding the ends of a canvas (2) which determines the opening and closing of the door.

Figure 2:
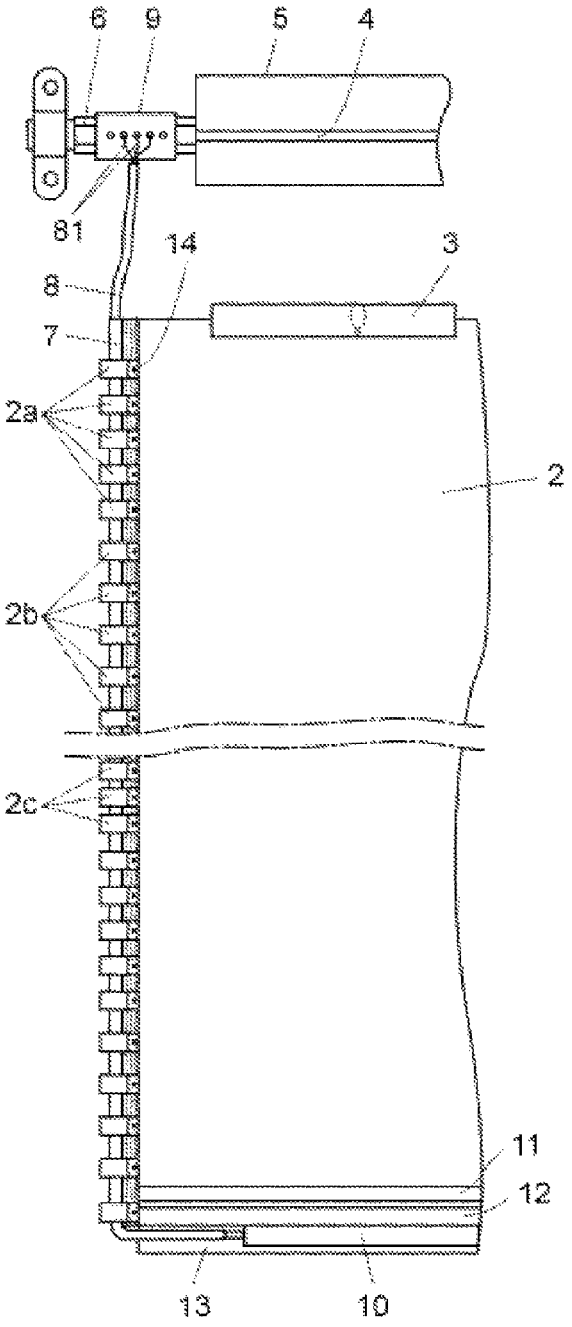
FIG. 2 shows a front elevation view of one of the side ends of the canvas, released from the winding drum and with the electrical cables contained in the hose, which is mounted on the end of the canvas, connected to a radio transmitter secured to the shaft of a motor driven drum.
Figure 3:
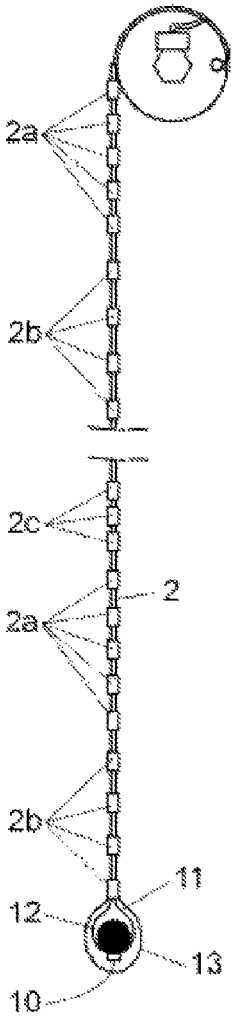
FIG. 3 shows a side view of the canvas engaged on the motor driven drum being appreciated inside of the same the sensor bar.
Figure 4:
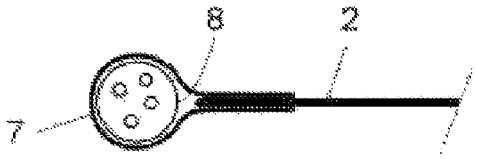
FIG. 4 shows a detail in an upper plan view of the hose containing electrical cables secured to one of the ends of the canvas by means of a support sheath welded to the canvas.

As may be observed in FIG. 2 the canvas (2) has in its upper end a tubular element (3) for its engagement within a lengthwise channel of the motor driven drum (5) assembled on the drive shaft (6). The canvas (2) has in its said ends a sheath (7) welded to the canvas (2) which internally supports a hose (8) carrying electrical cables, as may be observed more clearly in FIG. 4.

The electrical cable carrying hose (8) has in its interior electrical cables (81) connected to a signal transmitter (9) and to a band (10) to detect the contact and, located together with the sheath (11) which contains a weight (12) within a bag (13) to adjust the canvas to the floor.

Said band (10) to detect the contact has the function to detect the collision of the canvas against any object during its displacement towards the lower closing position.

On the side ends of the canvas (2) a plurality of abutment elements (2*a*, 2*b*, 2*c*) are assembled forming groups with different separations between the successive abutment elements.

Figure 5:
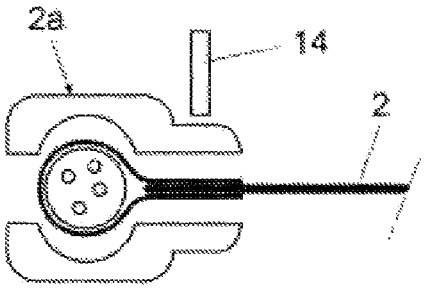
FIG. 5 shows a similar view to that of the previous figure, with an example of an embodiment of the abutment elements formed in this case by two side parts which are self-centering in respect to the hose containing in the electrical cables to be fixed together.

This arrangement of the abutment elements permits said abutment elements to carry out the detection and identification of the different position of the door when said abutment elements (2*a* 2*b*, 2*c*) with differentiated separations are sequentially detected by sensors located in a passage area of the same preferably in the upper end of the vertical uprights (1), being formed each of the abutment elements (2*a*, 2*b*, 2*c*) by two complementary parts assembled on the opposed side of the lateral ends of the sheet (2) as shown in FIG. 5, which are self-centering in respect to of the electrical cable containing hose (8) and are secured one to the other by means of screws or similar tensioning elements (14).

Figure 6:
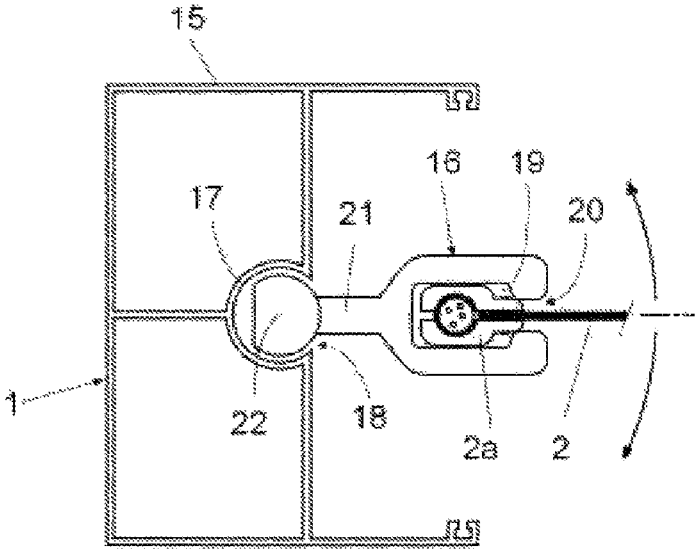
FIG. 6 shows an upper plan view of an example of embodiment of one of the vertical uprights of the door formed by a vertical profile and a guide member assembled on said profile with the possibility of swiveling movement or sideways rotation.

FIG. 6 shows an example of one embodiment of the vertical uprights (1) of the door formed in this case from a vertical profile (15) and a guide member (16) also vertical for guiding the abutment elements (2*a* 2*b*, 2*c*) of the canvas (2) during the opening and closing movements of the door.

The profile (15) has a channel (17) with a front opening mouth (18) while the guide member (16) also vertical has an internal passage (19) for the vertical displacement of the abutments elements (2*a* 2*b*, 2*c*) of the canvas (2) and a front opening (20) for the passage and vertical circulation of the side ends of the said canvas (2). The guide member (16) has a back arm (21) ending in an appendage (22), in this case in form of a vase located within the channel (17) of the profile (15) with possibility of sideways rotation which permits the swiveling or sideways rotation of the guide member (16) depending of the tension efforts transmitted by the sheet closing element (2).

This permits the guide member (16) to swivel sideways orientating more or less towards the external side or towards the internal side of the door when the canvas (2) curves itself towards one or the other lateral sides due to the action on the same of a frontal or oblique push.

Figure 7:
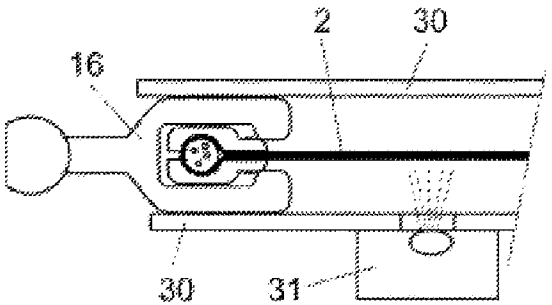
FIG. 7 shows a plan view of the guide member with two metallic supports bonded to both ends of the same being secured in one of said supports an optical sensor detecting the vertical displacement of the canvas.

FIG. 7 shows an example of an embodiment in which the guide member (16) has bonded supports (30) having dimensions appropriate to its objective containing, at least one of them, an optical sensor (31) for the detection of the vertical displacement of the canvas (2). Said support (30) may contain in its turn an antifriction material serving for the guiding and reintroduction of the canvas (2) in to the guide member (16) after a collision on said canvas (2).

Figure 8:
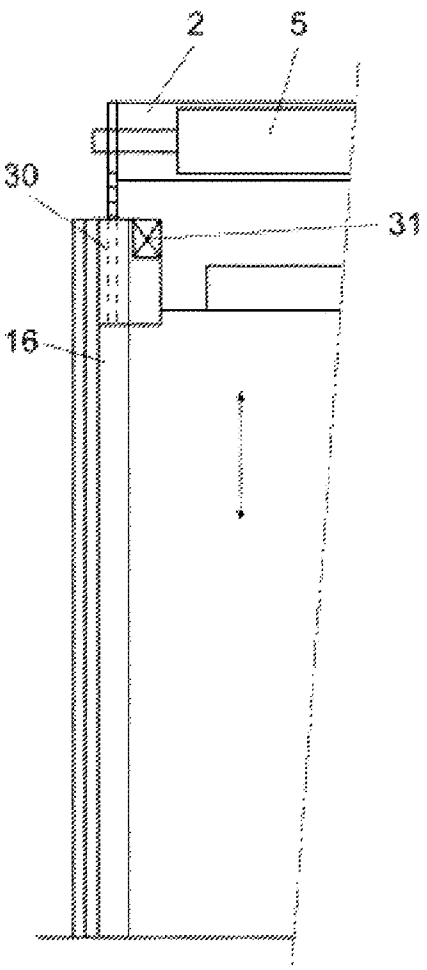
FIG. 8 shows a front view of the guide member with the metallic supports containing the optical sensor, both located in the upper area of said guide member.

In FIG. 8, it may be observed that supports (30), as well as the optical sensor (31) are located in the upper part of the guide member (16).

After having sufficiently described the nature of the invention, as well as one preferred embodiment of the same, it is to be understood to all effects that the materials, form, size and arrangement of the described elements could be modified whenever this does not mean an alteration of the essential characteristics of the invention as claimed in the following.

The invention claimed is:

1. A Quick-opening door, comprising a flexible canvas, secured by its upper end to a motor-driven drum for its winding in an opening position and its unwinding in a closing position of the door; having said canvas on lateral ends there of vertical alignments of abutment elements which are guided in vertical uprights of the door during vertical displacement of the canvas, whereby said elements are released from the vertical uprights when the canvas receives a push action of a certain intensity; characterized in that it comprises at least:

a hose carrying electrical cables, covered by a tape or sheath and secured to one or both lateral ends of the canvas, containing at least one electrical cable connected to a wireless signal transmitter;

the plurality of abutment elements secured on the lateral ends of the tape or sheath and distributed along said lateral ends with different separations, with the capacity to displace vertically with respect to the vertical uprights of the door;

some sensors arranged in a passage area of the abutment elements which capture different sequences of impulses, during the passage of the abutment elements distributed with the different separations on the lateral ends of the canvas, determining the position of the canvas in any given moment; and a contact detecting band connected to the transmitter by means of the cables contained within the hose.

2. The door, according to claim 1, characterized in that the wireless signal transmitter is secured to the shaft of the motor driven drum.

3. The door, according to claim 1, characterized in that a bag for contacting the floor is secured to the lower end of the canvas, comprising in its interior a sheath containing a weight.

4. The door, according to claim 1, characterized in that each of the vertical uprights of the door comprises: a vertical profile with a channel having a frontal opening or mouth and an also vertical guide member, having an interior passage for the vertical displacement of the abutment elements, a front opening for the passage and vertical circulation of the lateral ends of the canvas having the abutment elements and a back arm ending in a vertical appendage which has at least portion located within the lengthwise channel of the profile with capacity for sideways rotation.

5. The door, according to claim 4, characterized in that the internal passage and the front opening of the guide member define a cross section in the form of a "U" elastically deformable in sufficient measure to permit the release of the abutment elements when the canvas is submitted to a frontal or oblique push of a particular intensity.

6. The door, according to claim 1, characterized in that the abutment elements secured to the lateral ends of the tape or sheath form protection means for the said tape or sheath against eventual blows and against deterioration by use.

7. The door, according to claim 1, characterized in that the tape or sheath forms self-centering means for the abutment elements.

8. The door, according to claim 1, characterized in that the lateral ends of the canvas have corresponding independent hoses containing electric cables.

9. The door, according to claim 1, characterized in that each vertical upright comprises in its upper part, some supports in which an optical sensor is located to detect the vertical displacement of the canvas.

10. The door, according to claim 9, characterized in that said supports comprise antifriction parts channeling the canvas towards the interior of the vertical uprights when said canvas has been released from said vertical upright.

11. The door, according to claim 1 characterized in that the cables located inside of the hose are connected to a mechanical transmitter to transmit signals in a non wireless form.

* * * * *